US005333334A

United States Patent [19]

Kassai

[11] Patent Number: 5,333,334

[45] Date of Patent: Aug. 2, 1994

[54] HUMAN BODY MOVING APPARATUS

[76] Inventor: Kenzou Kassai, 14-9, Higashishinsaibashi 1-chome, Chuo-ku, Osaka, Japan

[21] Appl. No.: 72,143

[22] Filed: Jun. 4, 1993

[30] Foreign Application Priority Data

Jun. 15, 1992 [JP] Japan ..... 4-040757
Sep. 30, 1992 [JP] Japan ..... 4-261941
Oct. 13, 1992 [JP] Japan ..... 4-071204

[51] Int. Cl.[5] ..... A61G 7/10; A61G 7/14
[52] U.S. Cl. ..... 5/85.1; 5/86.1
[58] Field of Search ..... 5/81.1-89.1, 5/424, 600

[56] References Cited

U.S. PATENT DOCUMENTS 2,125,546 8/1938 Corr ..... 5/86.1
2,539,566 1/1951 Bedard ..... 5/85.1
5,177,822 1/1993 Kassai ..... 5/81.1
5,181,289 1/1993 Kassai ..... 5/612
5,235,712 8/1993 Smith ..... 5/85.1

FOREIGN PATENT DOCUMENTS 0475691 3/1992 European Pat. Off. .
2-215462 8/1990 Japan ..... 5/81.1
695660 8/1953 United Kingdom ..... 5/85.1

*Primary Examiner*—Alexander Grosz

[57] ABSTRACT

In a human body moving apparatus, a coupling bar couples upper ends of a pair of upwardly extending upright bars with each other, to define a prescribed space between the pair of upright bars. Base members are provided on lower end portions of the upright bars respectively, while plural wheels are mounted on the base members to roll on a floor surface or on guide rails. A support member for supporting a human body is mounted to be movable along the upright bars and stoppable at a moved position. The support member includes two parallel side bars extending across the pair of upright bars respectively.

14 Claims, 8 Drawing Sheets

HUMAN BODY MOVING APPARATUS

BACKGROUND OF THE INVENTION

1. Field of the Invention

The present invention relates to a human body moving apparatus which is employed for moving a sick person, a handicapped person or a bed-ridden old person (hereinafter simply referred to as "sick person or the like"), for example, in order to nurse him or her.

2. Description of the Background Art

For example, Japanese Patent Laying-Open No. 2-215462 (1990) proposes an improved bed apparatus. This bed apparatus is rendered applicable to a room of a 6 tatami mat size, i.e. about 360 by 270 $cm^2$ or a room of a 4.5 tatami mat size, i.e. about 270 by 270 $cm^2$, for example, in consideration of housing circumstances in Japan, and provided with a human body moving mechanism which can raise up and lay down a sick person or the like from and onto the bed body and move him to the side of the bed body. This bed apparatus is also devised to help the sick person or the like to rehabilitate himself.

In more concrete terms, the human body moving mechanism provided in the aforementioned bed apparatus comprises a pair of upright bars upwardly extending with a prescribed space, a coupling bar coupling upper ends of the pair of upright bars with each other, and a support member for supporting a human body, which is mounted to be movable along the upright bars and stoppable at a moved position, including two parallel side bars extending across the pair of upright bars respectively. The pair of upright bars are guided to be movable along the cross direction of the bed apparatus on longitudinal end portions of the bed body respectively.

In the aforementioned human body moving mechanism, the pair of upright bars are movable between positions within the cross-directional dimension of the bed body and positions out of such cross-directional dimension. Further, the support member is vertically movable along the upright bars and stoppable at the moved position regardless of locations of the upright bars. Consequently, the two side bars included in the support member can be located in arbitrary positions within a range of spaces above and on a side of the bed body.

Due to such movement of the side bars, therefore, it is possible to move a sick person or the like who is laid on the bed body to the side of the bed body, and vice versa. According to this human body moving mechanism, therefore, it is possible to easily get the sick person or the like off the bed body to bathe him or help him into a wheelchair, and and then to return him onto the bed body.

In order to move the sick person or the like as described above, a proper hanger member is placed under the body of the sick person or the like and hooked on the side bars in practice. Thus, it is possible to move the sick person or the like in an arbitrary state such as a lying or sitting state by selecting the type of the hanger member.

In the aforementioned bed apparatus, the human body moving mechanism is securely mechanically connected with the bed apparatus. Namely, a mechanism for guiding the pair of upright bars which are included in the human body moving mechanism to be movable along the cross direction of the bed body is built into the mechanism of the bed body.

Therefore, the bed body is increased in weight and the assembly of this bed body is complicated since the mechanism for movably guiding the upright bars must be built into the bed body. Further, such a large-sized bed apparatus is rarely shipped in a completed state but leather components therefor are brought into the place of installation as independent pieces, to be assembled with each other on the spot. Therefore, the assembling operation is preferably simplified as much as possible.

When the mechanism for movably guiding the upright bars is built into the bed body, the range of movement of the upright bars which can be provided by such a guiding mechanism is naturally restricted in relation to the cross-directional dimension of the bed body. However, a movable range for the sick person or the like is preferably widened to the utmost.

SUMMARY OF THE INVENTION

Accordingly, an object of the present invention is to provide a human body moving apparatus which can be assembled independently of a bed body, with a movable range not restricted in relation to dimensions of the bed body.

The human body moving apparatus according to the present invention comprises a pair of upright bars upwardly extending with a prescribed space therebetween, while a coupling bar couples upper ends of the pair of upright bars with each other for defining the space therebetween. A pair of base members is provided on lower end portions of the pair of upright bars respectively. A support member for supporting a human body is mounted to be movable along the aforementioned upright bars and stoppable at a moved position. This support member comprises two parallel side bars extending across the pair of upright bars respectively. A plurality of rotatable wheels are mounted on each of the aforementioned base members respectively.

The human body moving apparatus according to the present invention itself comprises the wheels, to be movable to an arbitrary position with the wheels rolling on a floor surface, for example. Therefore, it is possible to freely horizontally move a human body held by such a human body moving apparatus on a floor surface, for example, while it is also possible to vertically move the human body in any moved position following movement of the support member along the upright bars.

According to the present invention, therefore, a human body moving apparatus is provided which can be handled and assembled independently of a bed body. Considering assembly steps up to a stage of assembly of the aforementioned bed apparatus comprising a human body moving mechanism together with a bed body, therefore, assembly of the bed body is relatively simplified while the inventive human body moving apparatus and the bed body can be assembled in parallel with each other, whereby the assembling time can be reduced.

The human body moving apparatus according to the present invention comprises two parallel side bars extending across the pair of upright bars as the support member for supporting the human body. When the human body moving apparatus is combined with a bed body, the longitudinal dimension of the bed body is kept within a space between the pair of base members and the pair of upright bars. In this state, the two parallel side bars are arranged in parallel with a sick person or the like who is laid on the bed body. When the two side bars are so employed that a hanger member which is placed under the body of the sick person or the like is hooked on the same, therefore, it is possible to easily move the sick person or the like in a lying state. When the sick person or the like who sits up on the bed body is wrapped in a hanger member which is in the form of a hammock and this hanger member is hooked on the side bars, on the other hand, it is possible to easily move the sick person or the like in a sitting state.

According to the inventive human body moving apparatus, therefore, it is possible to raise the sick person or the like from the bed body, move him to the side on the of the bed body, and vertically move him on the beside the bed body. In particular, it is possible to move the sick person or the like to the side of the bed body in an arbitrary direction by an arbitrary distance within rollable ranges of the wheels. Consequently, it is possible to easily move the sick person or the like to a bathtub for bathing or a chamber pot for evacuation, help him into a wheelchair, or return him onto the bed body.

The inventive human body moving apparatus is applicable not only to movement of a human body, but to rehabilitation for a sick person or the like. For example, the sick person or the like can stand between the two parallel side bars and grasp the same with his hands, to take walking exercise. If the sick person or the like cannot take walking exercise by himself, it is possible to wrap the upper half of his body in a hammock and suspend the hammock from the coupling bar, to support his body. Further, the inventive human body moving apparatus can be combined with a bed so that the sick person or the like can take exercise by sitting up in the bed while supporting the upper half of his body with his hands grasping the side bars. When a pulley is mounted on one of the side bars or the coupling bar to extend a rope along the pulley, the sick person or the like can exercise his arms by grasping both end portions of the rope with his hands and alternately vertically moving the arms. Similarly, he can vertically move both or one leg by grasping one end of the rope with both or one hand and engaging both or one ankle with the other end of the rope for vertically moving both or one arm. Thus, he can exercise his arm(s) and leg(s).

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 5 is a perspective view showing side bars 12 and 13 provided in the human body moving apparatus 1 holding a sick person or the like;

DESCRIPTION OF THE PREFERRED EMBODIMENTS AND OF THE BEST MODE OF THE INVENTION

Figure 1:
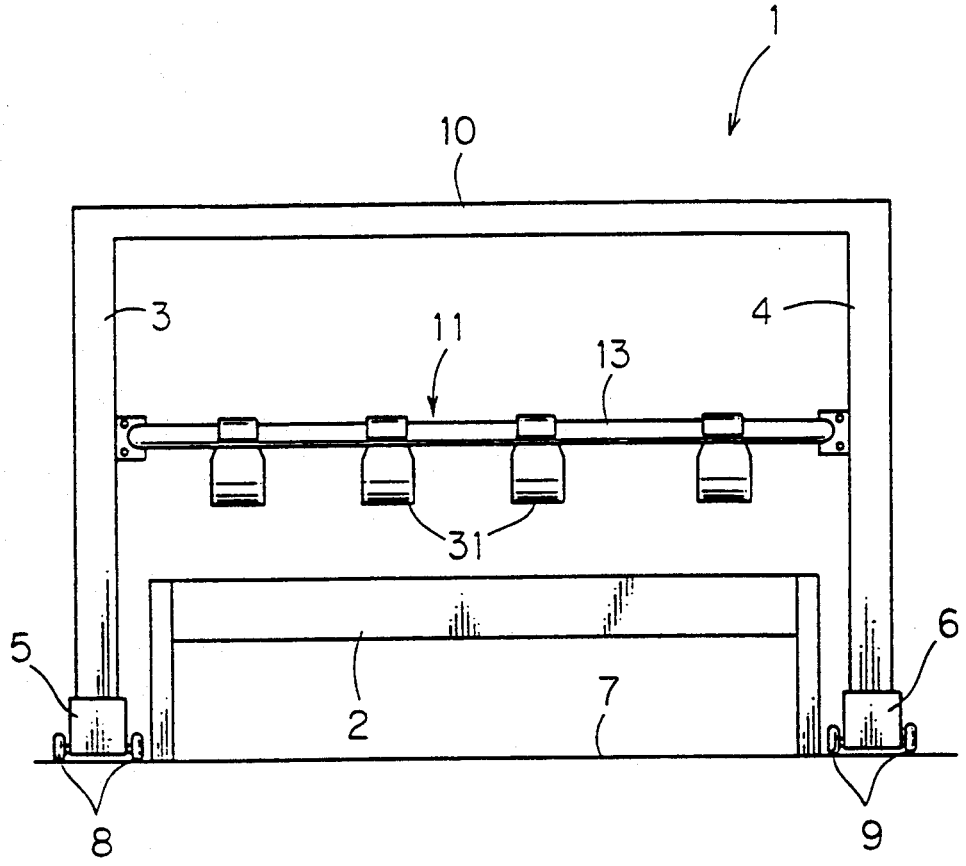
FIG. 1 is a front elevational view showing a human body moving apparatus 1 according to an embodiment of the present invention together with a bed 2.
Figure 2:
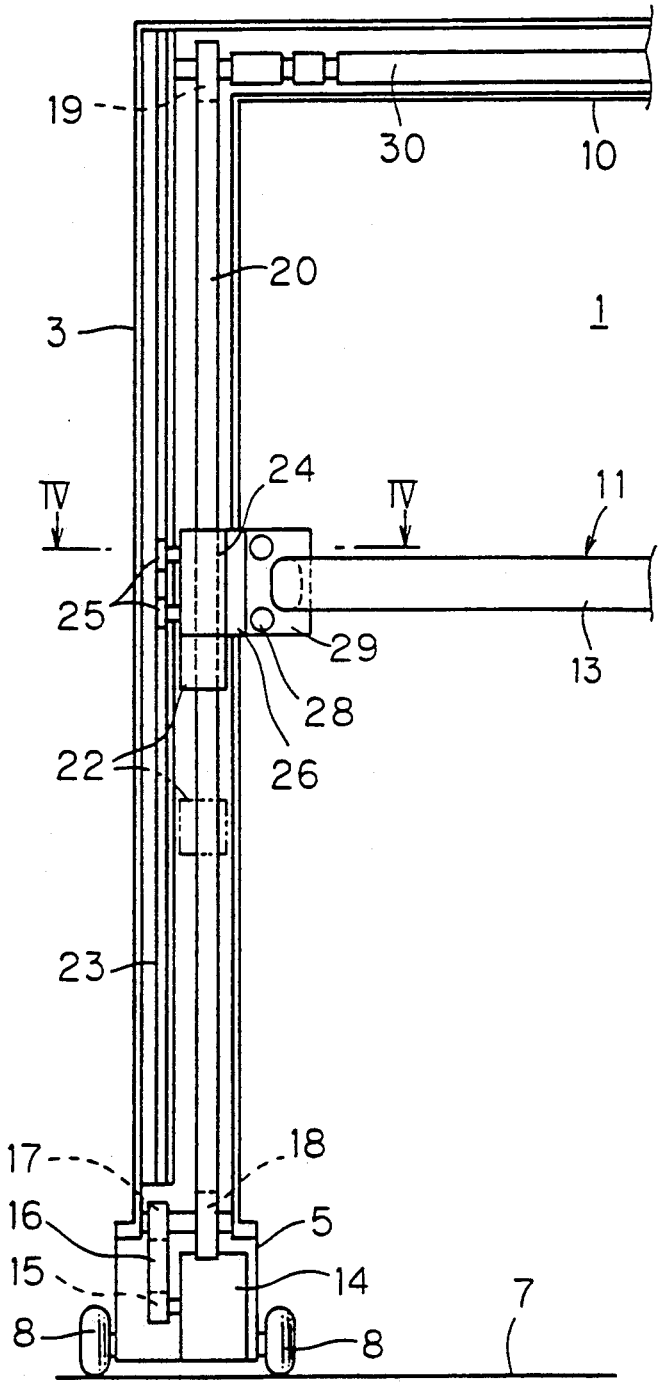
FIG. 2 is a front elevational view showing a structure related to an upright bar 3 provided in the human body moving apparatus 1, shown in a see-through manner.
Figure 3:
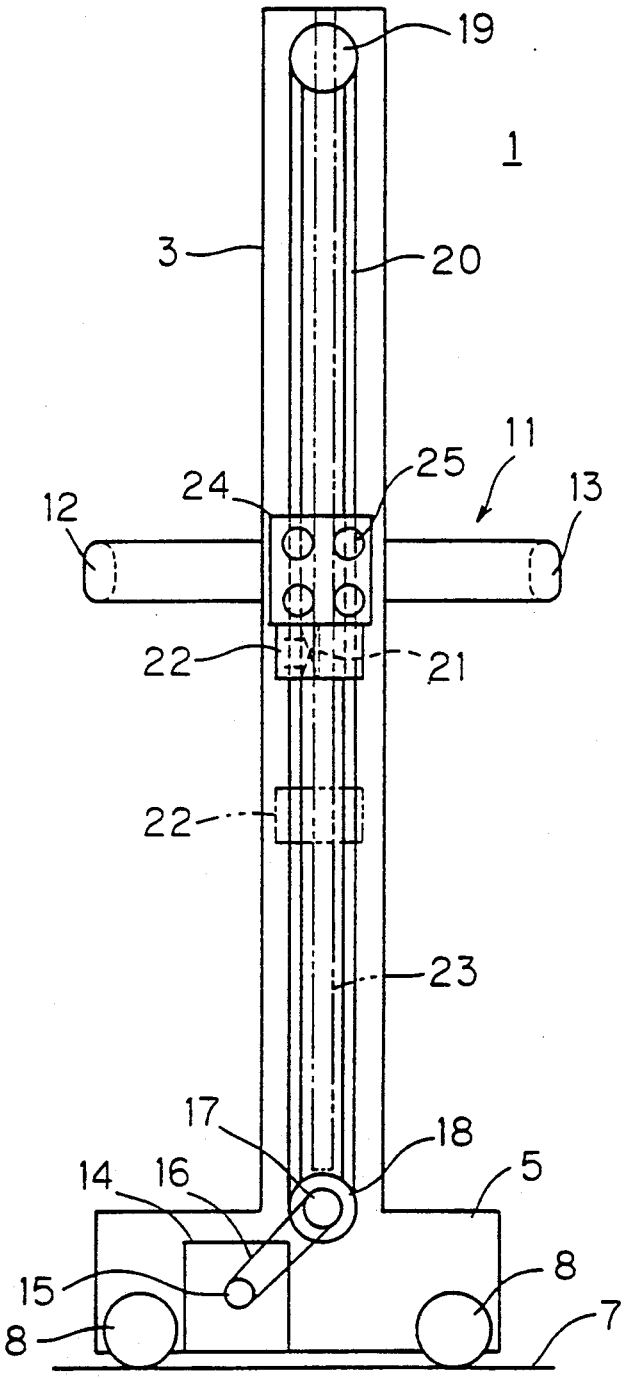
FIG. 3 is a left side elevational view showing the structure related to the upright bar 3 shown in FIG. 2, also shown in a see-through manner.
Figure 4:
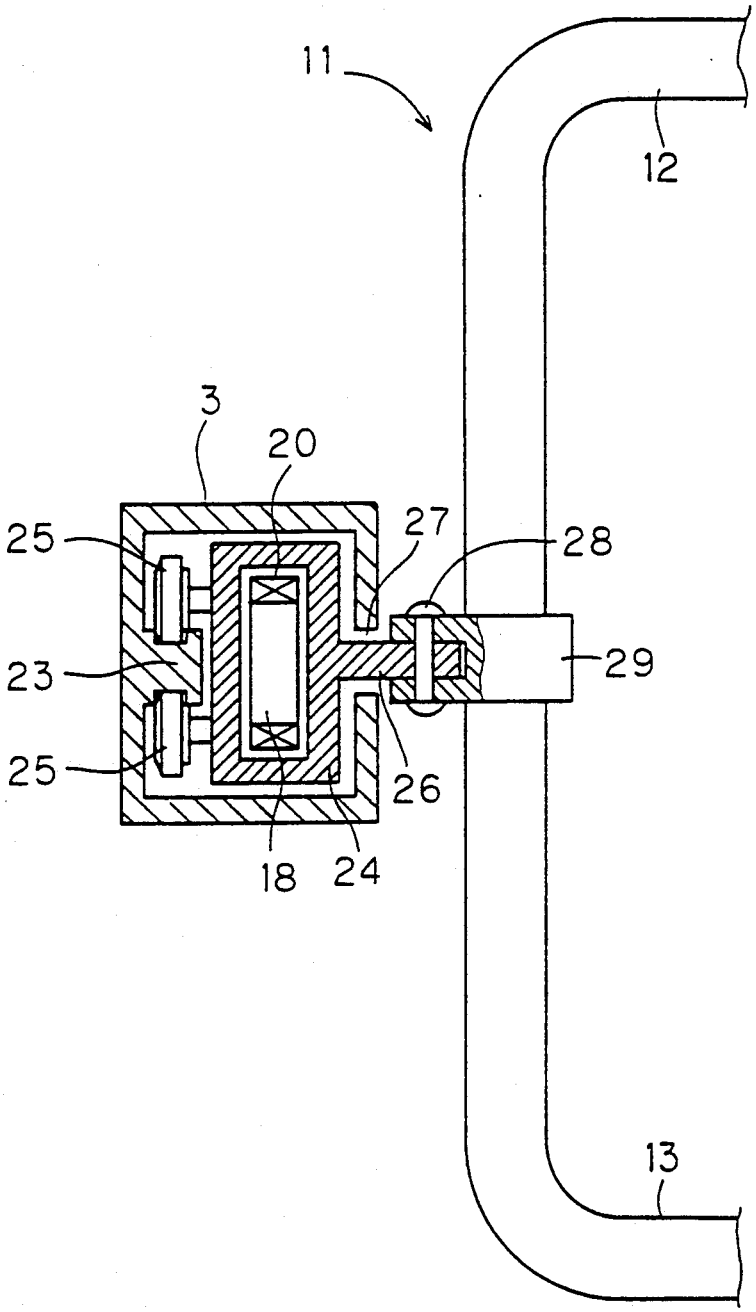
FIG. 4 is an enlarged sectional view taken along the line IV—IV in FIG. 2.

FIG. 1 is a front elevational view showing a human body moving apparatus 1 according to an embodiment of the present invention together with a bed 2. As shown in FIG. 1, the human body moving apparatus 1 comprises a pair of upright bars 3 and 4 upwardly extending with a prescribed space, namely a space exceeding the longitudinal dimension of the bed 2 according to this embodiment, being defined therebetween. FIGS. 2 to 4 show a structure which is related to the upright bar 3 in detail. FIGS. 2 and 3 are respectively a front elevational view and a left side elevational view showing the interior of the upright bar 3 etc. in a see-through manner. FIG. 4 is an enlarged sectional view taken along the line IV—IV in FIG. 2.

Base members 5 and 6 are provided on lower end portions of the upright bars 3 and 4 respectively. Plural wheels 8 and 9 are mounted on the base members 5 and 6 to be rollable on a floor surface 7.

A coupling bar 10 couples upper ends of the upright bars 3 and 4 with each other in order to maintain a constant space therebetween, thereby maintaining a constant positional relation between the pair of base members 5 and 6.

A support member 11 for supporting a human body is mounted to be movable along the upright bars 3 and 4 and stoppable at a moved position. This support member 11 comprises two parallel side bars 12 and 13 extending across the pair of upright bars 3 and 4 respectively.

With reference to FIGS. 2 to 4, the structure which is related to the upright bar 3 is now described. A structure which is related to the other upright bar 4 is substantially similar to that related to the upright bar 3, except for a specific difference described in particular below.

A motor 14 having a brake function is provided in the interior of the base member 5, so that rotation of this motor 14 is transmitted to a sprocket wheel 18 through a pulley 15, a belt 16 and another pulley 17. Another sprocket wheel 19 is provided on an upper end portion of the upright bar 3, and an endless chain 20 extends around the sprocket wheels 18 and 19. The chain 20 has two paths or portions extending along the longitudinal direction of the upright bar 3, so that a driving member 22 is fixed by a fixture 21 to the chain 20 on a point of one of the chain paths or portions. Thus, the driving member 22 is driven by the motor 14 to be moved along the upright bar 3.

Further, a guide rail 23 is fixed to vertically extend along the upright bar 3. A driven member 24 is provided to be movable along this guide rail 23. A plurality of pairs, e.g., two pairs of rollers 25 are rotatably mounted on the driven member 24 to hold the guide rail 23 and roll thereon. The driven member 24 is placed on the driving member 22 in a manner so as to be separable from the driving member 22.

A bracket portion 26 formed on the driven member 24 projects from the upright bar 3 through a slot 27 which is formed along the longitudinal direction of the upright bar 3. This bracket portion 26 holds the aforementioned side bars 12 and 13. More precisely, a fixture 29 is fixed to the bracket portion 26 by two pins 28, for example. Respective end portions of the side bars 12 and 13 are bent toward the fixture 29 and received therein, to be fixed to the same.

While the structure related to the upright bar 3 has been described, the other upright bar 4 is also provided with elements corresponding to those related to the upright bar 3, except those corresponding to the motor 14, the pulley 15, the belt 16 and the pulley 17. In order to transmit driving force of the motor 14 to the other upright bar 4, the rotation of the sprocket wheel 19 is transmitted to a corresponding sprocket wheel provided on the upright bar 4 through a synchronous shaft 30. The synchronous shaft 30 is arranged in the aforementioned coupling bar 10.

A method of using the human body moving apparatus 1 is now described.

Figure 5:
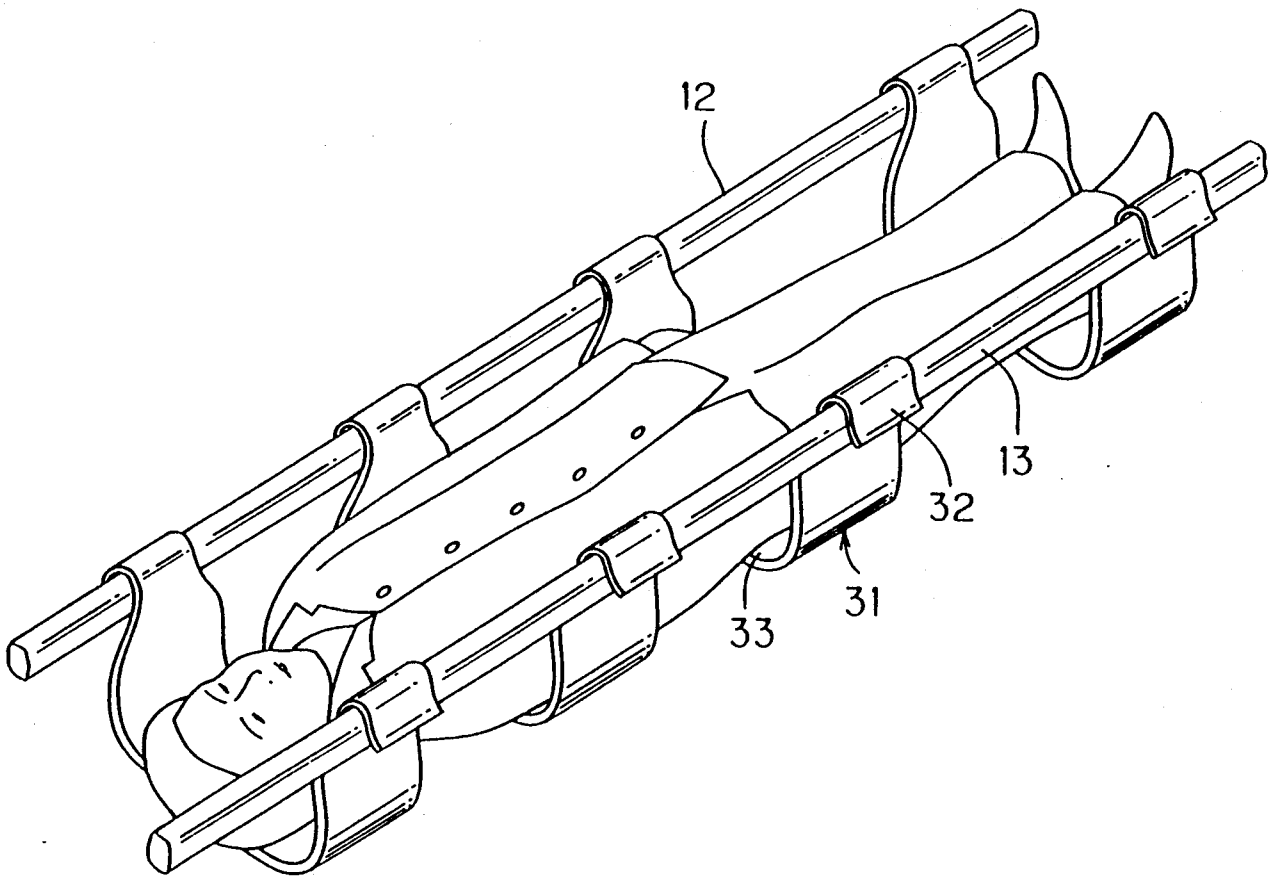

FIG. 5 shows the two side bars 12 and 13 in a typical state of holding a sick person or the like. As shown in FIG. 5, the sick person or the like is held in a lying state by the two side bars 12 and 13 through a plurality of hanger shovels 31.

The hanger shovels 31 are made of a relatively rigid material such as hard plastic, an aluminum alloy or stainless steel, for example. Each of the hanger shovels 31 is curved in an L-shaped form as a whole, and provided on one end with a hook portion 32 which is engageable with either one of the side bars 12 and 13.

A horizontally extending bottom surface portion 33 of each hanger shovel 31 is inserted under the body of the sick person or the like who is laid on the bed 2 (FIG. 1), for example, and then the hook portion 32 is engaged with either one of the side bars 12 and 13. The plurality of hanger shovels 31 are properly distributed on both sides of the body of the sick person or the like in consideration of his weight.

It is possible to advantageously insert the aforementioned hanger shovels 31 under the body of the sick person or the like without raising him.

When the sick person or the like is held by the two side bars 12 and 13 through the hanger shovels 31 as shown in FIG. 5 and the driving members 22 are vertically moved by the motor 14, the sick person or the like is vertically moved or lifted, correspondingly with the vertical movement of the side bars 12 and 13. Further, it is possible to horizontally move the sick person or the like by manually pushing or pulling the human body moving apparatus 1 so that the wheels 8 and 9 roll on the floor surface 7 thereby moving the overall human body moving apparatus 1. Through such movement, it is possible to raise up or lay down the sick person or the like from or onto the bed 2, or move him to the side of the bed 2 for bringing him into a bathtub. When the hanger shovels 31 are replaced by a hanger member such as a hammock for holding the sick person or the like in a sitting state, it is possible to move him to the side of the bed 2 in the sitting state in order to help him into a wheelchair or onto a chamber pot.

In the aforementioned method, the side bars 12 and 13 are downwardly moved so that the hook portions 32 of the hanger shovels 31 are engaged with the same, for example. Namely, the side bars 12 and 13 are located in positions close to the upper end portions of the upright bars 3 and 4 in an unused or stored state, while the same are downwardly moved toward positions close to both sides of the body of the sick person or the like who is laid on the bed 2 when the hook portions 32 of the hanger shovels 31 are to be engaged with the same. If the bed 2 is in an improper positional relation with the human body moving apparatus 1 at this time, either one of the side bars 12 and 13 may touch the body of the sick person or the like. If the user or operator of the apparatus notices this during downward movement of the side bars 12 and 13, he can stop the side bars 12 and 13 to prevent the same from hitting the body of the sick person or the like. If he fails to notice this, however, either one of the side bars 12 and 13 may hit the body of the sick person or the like. According to this embodiment of the invention, it is possible to downwardly move only the driving members 22 as shown by phantom lines in FIGS. 2 and 3 while stopping the side bars 12 and 13 if the same collide with an obstacle during downward movement. Namely, as described above, the driven member 24 is placed separably on the driving member 22, whereby the driven member 24 separates from the driving member 22 if the side bars 12 and 13 encounter an obstacle during downward motion. Therefore, the side bars 12 and 13 are not influenced by the driving force applied to the driving members 22 by the motor 14. Thus, it is possible to reliably prevent the side bars 12 and 13 from being influenced by such driving force, thereby protecting the sick person or the like against an injury caused by a strong pressure which may be applied by one of the side bars 12 and 13. Consequently, the human body moving apparatus 1 can be remarkably improved in safety for the sick person or the like.

In addition to the sick person or the like who is laid on the bed 2, the sick person or the like sitting on a wheelchair or a chamber pot, or an apparatus such as the bed 2, the wheelchair, the chamber pot or a bathtub itself may obstruct the downward movement of the side bars 12 and 13. Particularly when the apparatus obstructs the downward movement of the side bars 12 and 13, this leads to a problem of possible mechanical damage if the driving and driven members 22 and 24 are inseparable from each other. According to this embodiment, however, it is possible to solve such a problem of mechanical damage since the driving and driven members 22 and 24 are separable from each other.

In relation to the aforementioned embodiment, the following modifications and others are within the scope of the present invention.

While the synchronous shaft 30 is so employed that the single motor 14 drives both mechanisms provided in relation to the upright bars 3 and 4 in the aforementioned embodiment, alternatively the upright bars 3 and 4 may each be provided with such a motor respectively.

In the aforementioned embodiment, the chains 20 and the sprocket wheels 18 and 19 are employed in order to drive the driving members 22 for the support member 11 along the upright bars 3 and 4 respectively. Alternatively, combinations of belts and pulleys, or threaded spindle shafts and driving members having female threads to be engaged with the spindle shafts may be employed.

The driving and driven members 22 and 24 are separable from each other in order to improve the human body moving apparatus 1 in safety for the sick person or the like in the aforementioned embodiment. If such an advantage is not desired, however, the driving and driven members 22 and 24 may be inseparable from each other.

The human body moving apparatus 1, which is used with the bed 2 in the aforementioned embodiment, is preferably moved in a state properly located with respect to the bed 2. When the human body moving apparatus 1 and the bed 2 are used in a relatively narrow room, further, it is rather difficult to move the human body moving apparatus 1 since a moving path for the human body moving apparatus 1 is restricted. An embodiment which can solve this problem is now described.

Figure 6:
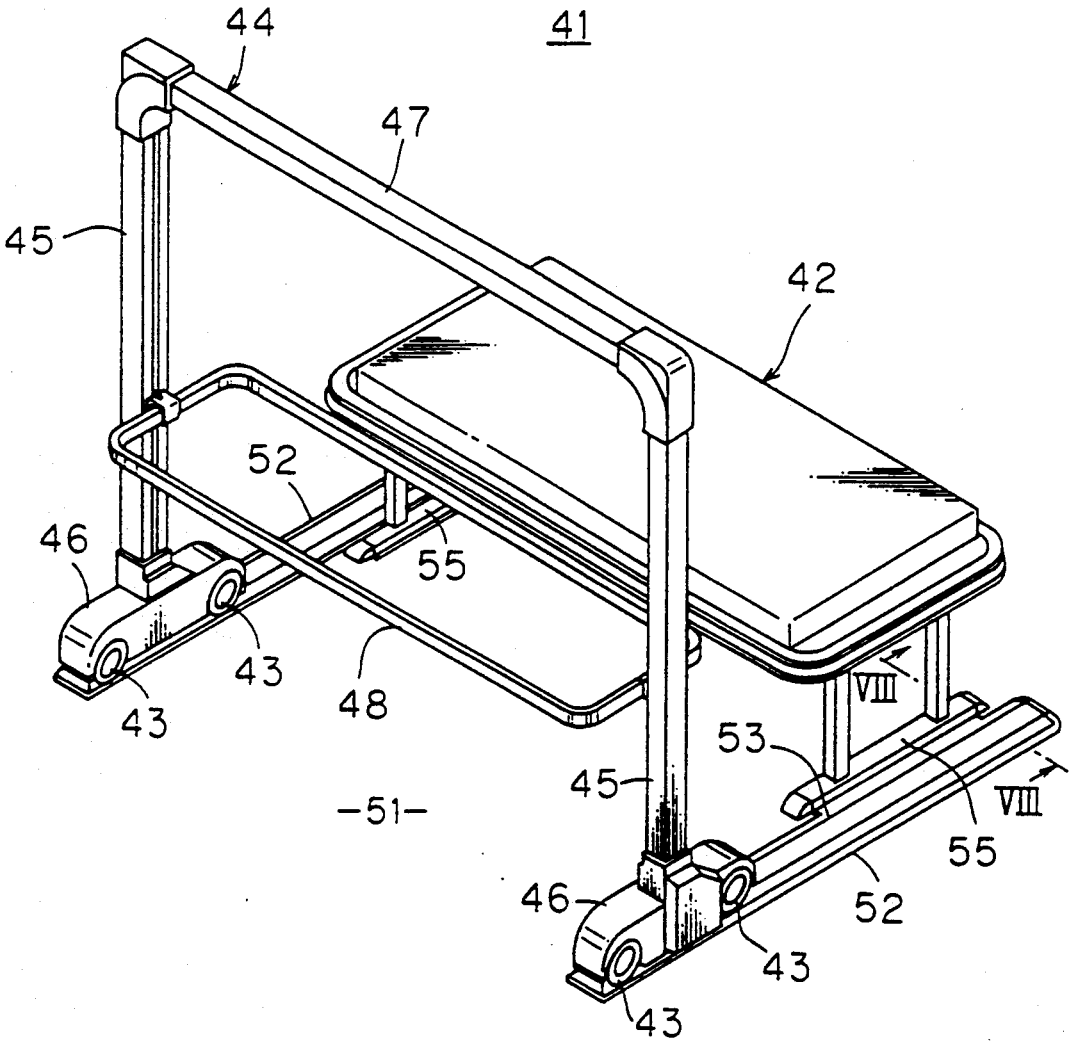
FIG. 6 is a perspective view showing a bed apparatus 41 according to another embodiment of the present invention.
Figure 7:
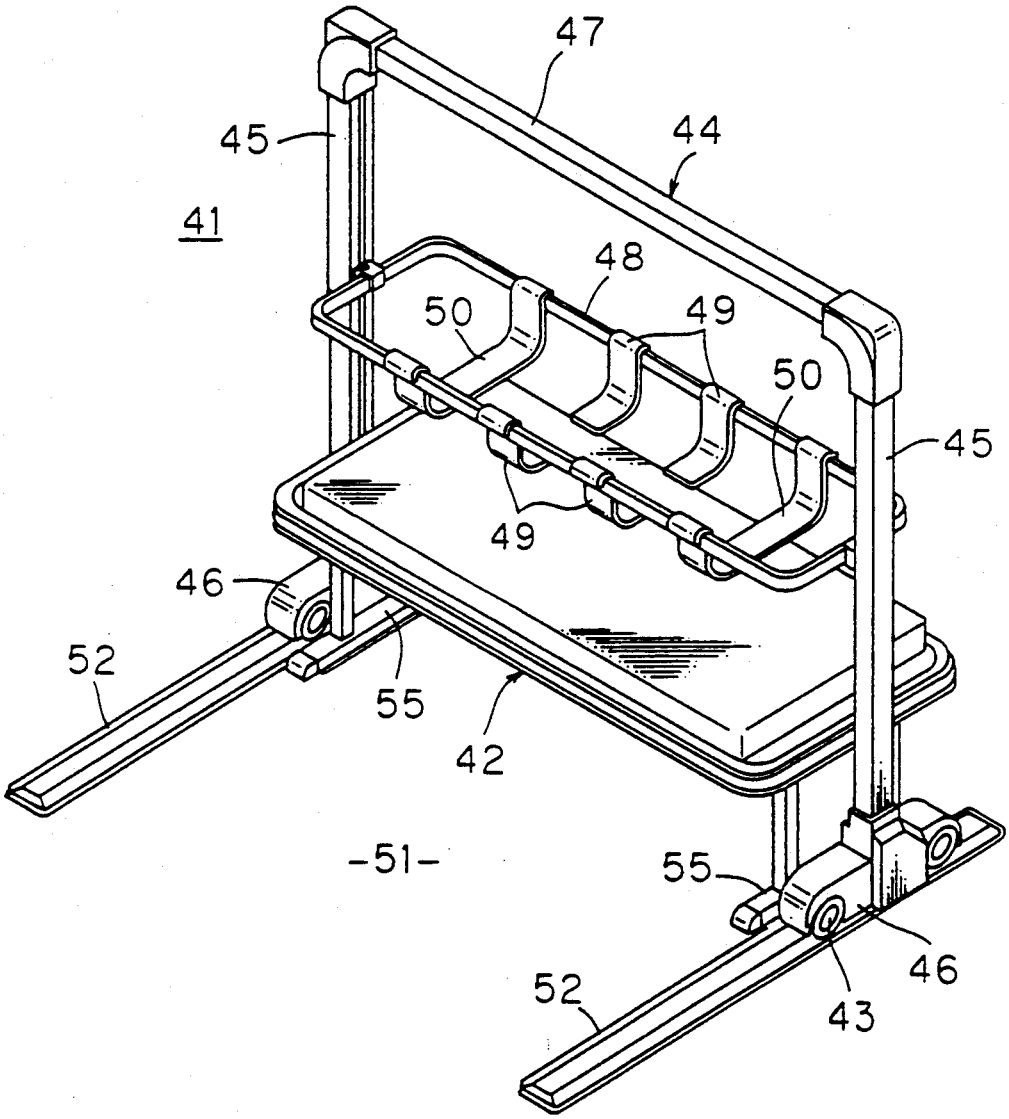
FIG. 7 is a perspective view showing the bed apparatus 41 in a state different from that shown in FIG. 6.

FIGS. 6 and 7 are perspective views showing different states of a bed apparatus 41 according to another embodiment of the present invention.

The bed apparatus 41 comprises a bed body 42 and a movable human body moving apparatus 44, which is used in combination with the bed body 42, having a mechanism for lifting a human body and wheels 43.

The bed body 42 may have a hinged bed surface (not shown).

On the other hand, the human body moving apparatus 44 comprises a pair of upright bars 45 which are arranged with a space exceeding the longitudinal dimension of the bed body 42. Base portions 46 are provided on lower end portions of the upright bars 45, so that the aforementioned wheels 43 are mounted thereon. A crossbar 47 couples upper ends of the pair of upright bars 45 with each other, to define the space therebetween. A support member 48 which is in the form of a rectangular frame, for example, is provided to be vertically movable along the upright bars 45 and stoppable at a moved position.

The support member 48 is adapted to support the body of a sick person or the like who is moved by the human body moving apparatus 44. In order to move the sick person or the like in a lying state, hanger shovels 49 and hanger bridges 50 are mounted on the support member 48, as shown in FIG. 7. Each of the hanger shovels 49 is curved in an L-shaped form as a whole, and adapted to receive one side of the human body. On the other hand, each of the hanger bridges 50 has a U-shaped form as a whole, and is suitable for receiving the head or feet of the human body. Such hanger shovels 49 and hanger bridges 50 may be replaced by a hammock or the like, which is suspended from the support member 48 for holding the human body in a sitting state.

Figure 8:
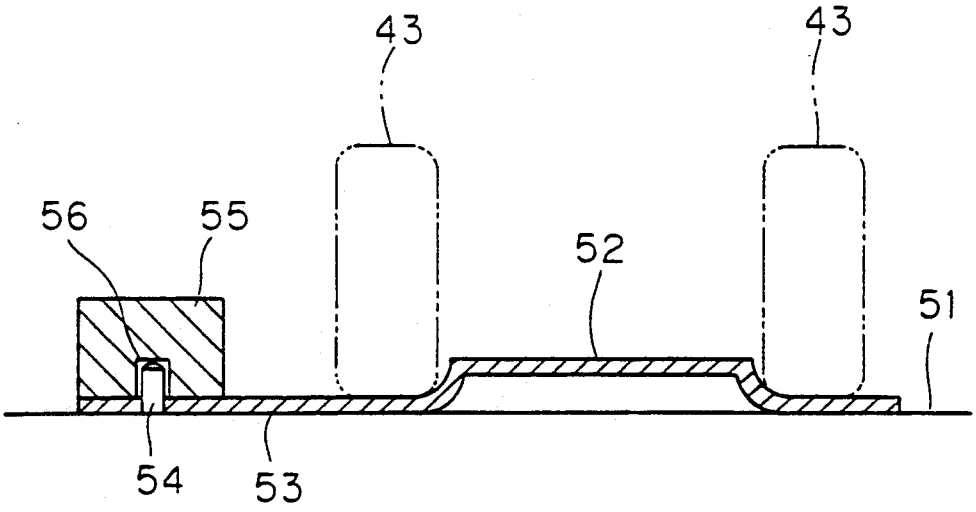
FIG. 8 is an enlarged sectional view taken along the line VIII—VIII in FIG. 6.

Rails 52 are placed on a floor surface 51 receiving the bed body 42, in order to provide tracks for the wheels 43. FIG. 8 is an enlarged sectional view taken along the line VIII—VIII in FIG. 6. As clearly understood from FIG. 8, each rail 52 is provided with a coupling member 53. This coupling member 53 is adapted to fix the rail 52 to the bed body 42 in a in a properly located relation with the same. In order to ensure such fixing and proper location, the coupling member 53 is provided with an upwardly projecting pin 54, while a location hole 56 for receiving the pin 54 is provided in a lower surface of each leg portion 55 of the bed body 42, for example.

The coupling member 53, which is integrally provided on each rail 52 as shown in FIG. 8, may be formed by a member independent of the rail 52, to be fixed to the same.

Thus, the rails 52 are properly located with respect to the bed body 42 and held properly in place by the weight of the bed body 42. The human body moving apparatus 44 can be located to the side of the bed body 42 as shown in FIG. 6, or within the cross-directional dimension of the bed body 42 as shown in FIG. 7 by means of the wheels 43 rolling along the rails 52. Proper end stops (not shown) may be provided on both end portions of the rails 52, in order to prevent the wheels 43 from falling on the floor surface 51 beyond the rails 52.

The support member 48 provided in the human body moving apparatus 44 is vertically movable along the upright bars 45 in both of the states shown in FIGS. 6 and 7. Through such vertical movement of the support member 48 and the movement of the human body moving apparatus 44 itself along the rails 52, therefore, it is possible to raise up the sick person or the like who is laid on the bed body 42 from the bed body 42, return him onto the bed body 42, move him to the side of the bed body 42, and vertically move him beside the bed body.

While each coupling member 53 as shown is fixed to the bed body 42 through the combination of the pin 54 and the location hole 56 and the weight of the bed body 42 itself, the former may be fixed to the latter through another structure.

According to this embodiment, as hereinabove described, the human body moving apparatus 44 can be moved in a state being properly located with respect to the bed body 42, whereby the human body moving apparatus 44 is not improperly displaced away from the bed body 42 as the result of movement. Thus, the human body moving apparatus 44 is not hindered from proper use.

Further, the human body moving apparatus 44 is moved along a prescribed moving path in relation to the bed body 42, whereby it is possible to avoid difficulty in operation for moving the human body moving apparatus 44 even if the same is placed in a relatively narrow room.

Although the present invention has been described and illustrated in detail, it is clearly understood that the same is by way of illustration and example only and is not to be taken by way of limitation, the scope of the present invention being limited only by the terms of the appended claims.

What is claimed is:

1. A human body moving apparatus comprising:

a pair of upright bars upwardly extending with a prescribed space therebetween;

a coupling bar for coupling upper ends of said pair of upright bars with each other;

a pair of base members provided on lower end portions of said pair of upright bars respectively;

a support member, for supporting a human body, being mounted to be movable along said upright bars and stoppable in a moved position and including two parallel side bars extending across said pair of upright bars respectively; and a plurality of rotatable wheels being mounted on each said base member;;

wherein said support member comprises driving members being driven to be moved along said upright bars and driven members being placed on said driving members to be separable therefrom for holding said two side bars.

2. The human body moving apparatus in accordance with claim 1, further comprising means for driving said driving members to be moved along said upright bars.

3. The human body moving apparatus in accordance with claim 2, wherein said driving means are provided in said upright bars.

4. The human body moving apparatus in accordance with claim 2, wherein said driving means include sprocket wheels located on upper and lower ends of said upright bars respectively and endless chains being extended along the same.

5. The human body moving apparatus in accordance with claim 4, further comprising a synchronous shaft for transmitting rotation of said sprocket wheels provided on upper ends of said upright bars to each other.

6. The human body moving apparatus in accordance with claim 5, wherein said synchronous shaft is provided in said coupling bar.

7. The human body moving apparatus in accordance with claim 1, further comprising guide rails extending along said upright bars for guiding said driven members to be moved along said upright bars.

8. The human body moving apparatus in accordance with claim 7, wherein said driven members comprise rotatable rollers rolling on said guide rails.

9. The human body moving apparatus in accordance with claim 1, further comprising a plurality of hanger shovels each being curved in an L-shaped form as a whole and having a hook portion being engageable with one of said side bars on one end.

10. The human body moving apparatus in accordance with claim 1, further comprising a plurality of hanger bridges each being in a U-shaped form as a whole and having hook portions being engageable with said side bars on both ends.

11. The human body moving apparatus in accordance with claim 1, further comprising rails for providing tracks for said wheels.

12. The human body moving apparatus in accordance with claim 1, further comprising:

a bed body;

a rail being placed on a floor surface receiving said bed body for providing a track for said wheels; and a coupling member for fixing said rail to said bed body in a state being located with respect to said bed body.

13. The human body moving apparatus in accordance with claim 12, wherein said coupling member is fixed to said rail and held between said bed body and said floor surface.

14. The human body moving apparatus in accordance with claim 13, wherein said coupling member comprises an upwardly projecting pin and said bed body has a location hole for receiving said pin.

* * * * *

UNITED STATES PATENT AND TRADEMARK OFFICE

CERTIFICATE OF CORRECTION

PATENT NO. : 5,333,334

DATED : August 2, 1994

INVENTOR(S) : Kanzou Kassai

It is certified that error appears in the above-indentified patent and that said Letters Patent is hereby corrected as shown below:

On the title page, insert the following information:
--[73] Assignee: Aprica Kassai Kabushikikaisha, Osaka, Japan--.

On the title page, above item [57], insert the following information:
--Attorney, Agent or Firm: W.F. Fasse; W.G. Fasse--.

Signed and Sealed this

Twenty-seventh Day of December, 1994

*Attest:*

*Attesting Officer*

Bruce Lehman

BRUCE LEHMAN

*Commissioner of Patents and Trademarks*